US010724261B2

(12) United States Patent
Morand

(10) Patent No.: US 10,724,261 B2
(45) Date of Patent: Jul. 28, 2020

(54) MOBILE-BOTTOM DEVICE FOR SWIMMING POOLS OR HOLLOW CAVITIES

(71) Applicant: AQUALIFT, Compans (FR)

(72) Inventor: Jean-Noël Morand, Paris (FR)

(73) Assignee: AQUALIFT, Compans (FR)

( * ) Notice: Subject to any disclaimer, the term of this patent is extended or adjusted under 35 U.S.C. 154(b) by 98 days.

(21) Appl. No.: 15/564,716

(22) PCT Filed: Apr. 9, 2015

(86) PCT No.: PCT/FR2015/050961
§ 371 (c)(1),
(2) Date: Oct. 5, 2017

(87) PCT Pub. No.: WO2016/162607
PCT Pub. Date: Oct. 13, 2016

(65) Prior Publication Data

US 2018/0112428 A1 Apr. 26, 2018

(51) Int. Cl.
*E04H 4/06* (2006.01)
*E04H 4/08* (2006.01)

(52) U.S. Cl.
CPC ..... *E04H 4/065* (2013.01); *E04H 4/084* (2013.01)

(58) Field of Classification Search
CPC ..... E04H 4/065
(Continued)

(56) References Cited

U.S. PATENT DOCUMENTS

2009/0235446 A1* 9/2009 Juracek ..... E04H 4/06 4/495

FOREIGN PATENT DOCUMENTS

| | | | |
|---|---|---|---|
| EP | 2103761 | A1 | 9/2009 |
| FR | 2823239 | A1 | 10/2002 |
| JP | S62 78367 | A | 4/1987 |

OTHER PUBLICATIONS

International Search Report mailed in PCT/FR2015/050961 dated Jan. 19, 2016.

* cited by examiner

*Primary Examiner* — Lauren A Crane
(74) *Attorney, Agent, or Firm* — Wissing Miller LLP

(57) ABSTRACT

A mobile-bottom device for swimming pools or hollow cavities comprising a frame (1) fixed to a meshed framework (2) comprising first profile sections (20) running in a first direction and belonging to at least one first plane P1 referred to as the upper plane, and second profile sections (21) superposed on the first profile sections (20) and running in a second direction preferably perpendicular to the first direction and belonging to a second plane P2 referred to as the lower plane and different from the first plane P1, means for raising and lowering the frame and the framework, means for motorizing the raising and lowering means. According to the invention, said first and second profile sections (20, 21) have a U-shaped cross section having a first face (201) and a second face (202) that are mutually parallel and connected by a third face (203) of height H, the first face and the second face being provided with openings organized in sequences along the length L of the profile section, each sequence comprising a series of N1 openings (2010) which are aligned and equidistant by a distance d1, said series being juxtaposed with a series of N2 openings (2011) which are aligned and equidistant by a distance d2 greater than d1, the third face (203) being provided with two rows of three openings (2030) which are aligned and equidistant by a distance d1 positioned facing the openings (2010) of the first and second faces, and with an elongate opening (2031) along the height H and surrounded by at least four openings (2032) which are aligned with the two rows of openings (2030);
(Continued)

each end of a profile section (20, 21) comprises openings on each face (201, 202, 203), and said profile sections are bolted together.

10 Claims, 6 Drawing Sheets

(58) Field of Classification Search
USPC ..... 4/495
See application file for complete search history.

MOBILE-BOTTOM DEVICE FOR SWIMMING POOLS OR HOLLOW CAVITIES

This application is a 371 of PCT/FR2015/050961, filed on Apr. 9, 2015, published on Oct. 13, 2016 under publication number WO 2016/162607, the disclosure of which is incorporated herein by reference.

TECHNICAL FIELD OF THE INVENTION

The invention relates to the field of movable bottoms for swimming pools or hollow cavities, able to be installed in these cavities and to be moved parallel to the main plane thereof. The invention relate particularly to swimming pools; any hollow cavity the top surface of which is to be successively covered and uncovered falls within the field of the invention.

PRIOR ART

The device according to the invention therefore makes it possible to transform a cavity or swimming pool either into an open cavity when the movable bottom is disposed at the bottom of said cavity, or into a floor when the movable bottom is in a so-called high position. In the case of a swimming pool, it is a case of transforming a cavity filled with water into a flat surface on which it is possible to move (walk, run, etc).

In existing systems, two main problems are posed: firstly the manufacture of platforms is laborious and expensive, in particular because of numerous different parts to be assembled. Normally, the platforms consist of a metal mesh comprising parallel longitudinal bars between which short transverse elements are inserted, fixed between two consecutive longitudinal bars. Thus the number of transverse elements is very large, which requires time and expertise to produce such a mesh; secondly this prior art requires the installation at the bottom of a swimming pool of a push and pull system able to raise and lower the platform able to serve alternatively as a swimming pool or floor. Moreover, the push and pull system is usually bulky and installation thereof at the bottom of the swimming pool gives rise to a not insignificant loss of volume of the part of the cavity used as a swimming pool.

By way of illustration, the document FR 2 823 239 is known, which describes such a device and is characterised by a platform composed of parallel lintels and parallel cross members forming together a structural mesh. The lintels and cross members are superimposed. Means for raising and lowering this platform comprise in particular a jack contained in the mesh as well as a set of cables controlled by the jack, and associated with attachment points in the walls of the cavity. This type of structure is completely adapted to the size of the cavity to be dealt with, so that its cost is high; the lintels and cross members must be cut on site, to measure; assembly thereof requires various operations necessarily executed by a skilled technician. In addition a very large number of mechanical parts are necessary.

The document FR 2 923 239 describes a device in the same field, intended for the same function. This device comprises only cross members so that a less good distribution of forces is achieved, compared with the device described in the previous document. However, this device is to be taken into account as an illustrative example of a movable bottom for a swimming pool.

These known devices must be considered to be "made to measure" assemblies, produced individually. They costs and their installation times are thereby high.

A need therefore exists for devices of this type able to be installed and used quickly, with unskilled personnel. Equipment that can be supplied in kit form and easy to assemble appears to be a real technical need.

DISCLOSURE OF THE INVENTION

The invention aims to remedy the drawbacks of the prior art and in particular to propose a device able to be assembled and used quickly, which adapts easily to diverse varied dimensions of swimming pools or hollow cavities.

To do this, a movable-bottom device is proposed for swimming pools or hollow cavities, comprising a frame fixed to a mesh framework comprising first so-called upper profiles extending in a first direction and belonging to at least one first plane P1 referred to as the upper plane and second so-called lower profiles superimposed on the first profiles and extending in a second direction preferentially perpendicular to the first direction and belonging to a second plane P2 referred to as the lower plane different from the first plane P1, means for raising and lowering the frame and the framework, and means for motorising the raising and lowering means.

According to a first aspect of the invention, said profiles have a U-shaped cross section having a first face and a second face parallel to each other and connected by a third face of height H, the first face and the second face being provided with openings organised in sequences over the length L of the profile, each sequence comprising a first series of N1 openings aligned and equidistant by a distance d1, said series being juxtaposed with a second series of N2 openings aligned and equidistant by a distance d2 greater than d1, N1 being less than or equal to N2; the third face being provided with two rows of N1 openings aligned and equidistant by a distance d1 placed opposite the openings of the first and second faces and an opening elongate over the height H and surrounded by at least four openings aligned with the two rows of openings; each end of a profile comprises openings on each face; and said profiles are bolted together.

Such an arrangement makes it possible to bring standardised profiles in situ, which can easily be cut to the required measurements before being assembled together to form both the framework and the frame; the other constituent means fit on such a structure in order to achieve all the necessary functionalities, main and ancillary. In particular the distance d1 and d2, which relate to the pitches between the openings measured over the length of the profiles, represent an advantageous standardisation in particular for the fabrication and then assembly of the profiles together.

Furthermore, the device according to the invention makes it possible, in particular through the relative and specific arrangement of the first and second profiles, to guide and pass the cable-type elements of the raising system, in an optimised fashion.

In particular, the device further comprises angle brackets provided with openings aligned on two levels for fixing at right angles two lower profiles constituting said frame, said angle bracket being bolted to each of said profiles. These angle brackets can be termed universal in that they are suitable whatever the dimensions of the profiles and therefore of the swimming pools concerned.

Furthermore, the device according to the invention comprises angle brackets provided with openings aligned on two levels for fixing at right angles a profile constituting the framework on a profile constituting the frame, said angle brackets being bolted to each other.

Moreover, the device may comprise stabilisation means placed at the periphery of the frame, able to achieve sliding contact between said frame and the internal wall of the swimming pool or hollow cavity. Preferably, the stabilisation means are disposed substantially at the plane P2.

More specifically, said stabilisation means comprise brushes fixed to the periphery of the frame, by means of a support able to be bolted to one of the first or second faces of a profile of the framework, and to its third face.

Furthermore, at the frame, at least one side constituting said frame preferentially comprises two parallel profiles fixed (bolted) to each other via an intermediate part.

Specifically, said raising and lowering means comprise at least one jack disposed substantially in said lower plane P2. Said jack may be motorised.

Specifically, said jack is fixed between two second profiles of the framework, said jack having a first fixed end and a second movable end guided on a plate and cooperating with at least one pulley; at least one cable is provided with a first end fixed to an anchoring point of the internal wall of the swimming pool or hollow cavity and a second end fixed to an anchoring element connected to the meshed framework.

More specifically, the raising and lowering means also comprise at least one intermediate metal sheet for fixing and guiding said jack, said metal sheet being able to be bolted to two second profiles.

According to a preferred embodiment of the invention, the number N1 of the first series of openings is equal to three; the number N2 of the second series of openings is equal to seven.

Without departing from the scope of the invention, said first and second faces of said profiles comprise rounded longitudinal edges; this avoids sharp and therefore dangerous edges during handling. In addition, cables or elongate elements may be guided and/or housed along these longitudinal edges.

BRIEF DESCRIPTION OF THE FIGURES

Other features, details and advantages of the invention will emerge from a reading of the following description, with reference to the accompanying figures, which illustrate.

For more clarity, identical or similar elements are marked by identical reference signs on all the figures.

DETAILED DESCRIPTION OF AN EMBODIMENT

Figure 1:
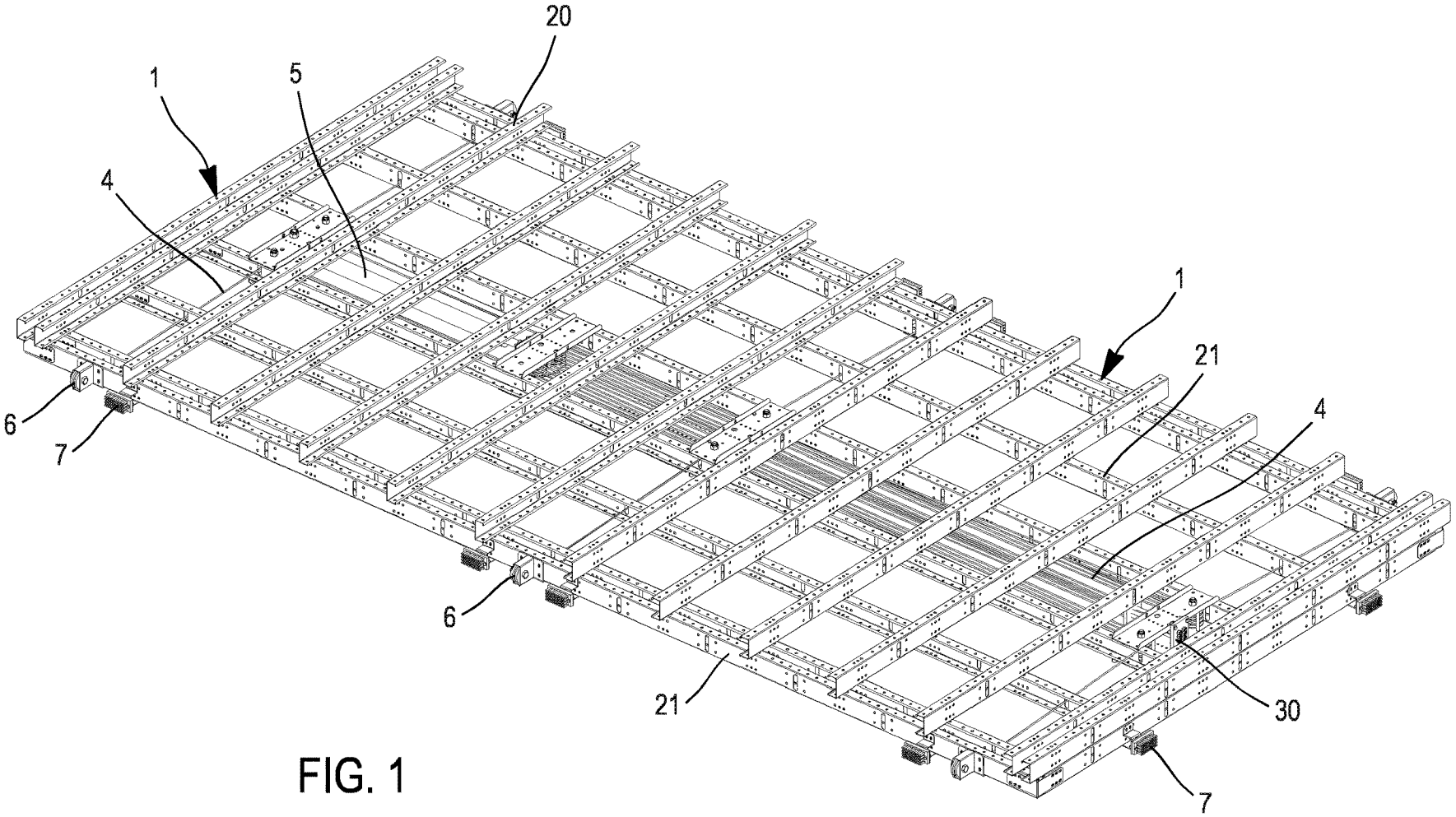
FIG. 1, a partial perspective view of a device according to a first embodiment of the invention.

FIG. 1 shows, by a schematic perspective view, the essential means constituting the invention. More particularly, the device according to the invention corresponds to a bolted assembly that comprise a frame 1 fixed to a meshed framework 2. Preferentially, these elements are made of metal, fixed together by bolting, as will be explained below. The meshed framework 2 comprises first profiles 20 extending in a first direction and second profiles 21 extending in a second direction generally perpendicular to the first direction. The first profiles 20 extend in a first plane P1 referred to as the upper plane while the second profiles extend in a second plane P2 referred to as the lower plane. Lower and upper should be understood in the common meaning of the term, that is to say one above the other. "Lower plane" or "upper plane" means in fact a thickness defined around a geometric plane.

Naturally the dimensions of the frame 1 and of the meshed framework 2 will be adapted to the profile of the swimming pool or cavity to be equipped; this sizing will be facilitated by the invention, in particular by virtue of the particular features of the profiles 1, 2.

The device according to the invention further comprises means for raising and lowering the frame 1 and the framework 2. As is known and as will be explained in more detail below, these means may comprise anchoring points 3 in the internal wall of the swimming pool, a set of cables or ropes 4 each tensioned between a first anchoring point 3 and a second anchoring point 30. Between these two points, multiple return and guide pulleys 6, 61 are provided, which determine a path for each cable 4. Advantageously, a motorised jack 5 is provided, with a first end fixed to the meshed framework, and a second end, to which return pulleys are fixed, is guided by a plate itself fixed to the framework. Advantageously, the jack 5 and the cables 4 are disposed in the lower plane P2. This arrangement allows an easier routing of the cables and better cooperation with the return pulleys 6 towards the first anchoring points 3.

A motorization is provided for controlling the jack 5, in a manner known per se.

Figure 2:
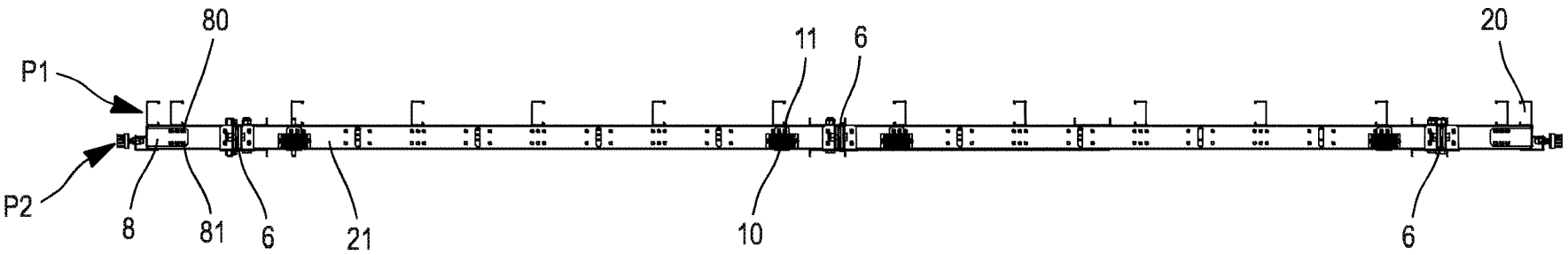
FIG. 2, a schematic side view of the device according to FIG. 1.

FIG. 2 shows in particular the superimposition of the first 20 and second 21 profiles, belonging respectively to the upper plane P1 and to the lower plane P2. This figure, which is a simplified side view, shows more precisely a profile 21 in its length, forming here one of the sides of the frame 1. Other means are fixed to the profile 21 of the frame 1, such as stabilisation means 7 intended to achieve sliding contact between the frame 1 and the internal wall of the swimming pool or cavity; the first return pulleys 6 are directly associated with each anchoring point 3 and provide a return at a right angle between the vertical direction, for the anchoring point in question, and a second return pulley 61 placed in the meshed structure. The second return pulleys 61 allow a routing in a horizontal plane, in the meshed structure of each cable 4 in question, as will be explained below.

Preferentially, the frame 1 is formed by a double row of profiles 20 arranged so that the means that are fixed thereto belong to the lower plane P2 for at least one direction. This aspect will be explained below in relation to FIG. 5 in particular.

Figure 3:
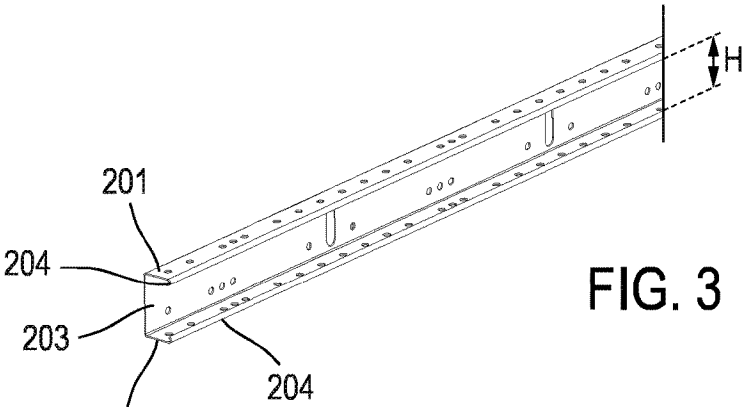
FIG. 3, a partial perspective view of a profile according to the invention.

FIG. 3 shows in perspective a characteristic profile of the invention. The profile 20, 21 has a U-shaped cross section, with a first face 201 and a second face 202 parallel to each other; the first and second faces 201, 202 are connected together by a third face 203 of height H corresponding to the distance between the first and second faces. Face means a wall that defines each part of the U-shaped profile. A rim 204 can advantageously be provided at the end of each first and second face 201, 202. The rim 204 avoids having sharp and therefore dangerous edges in particular for the operators when the profiles are handled.

Figure 4A:
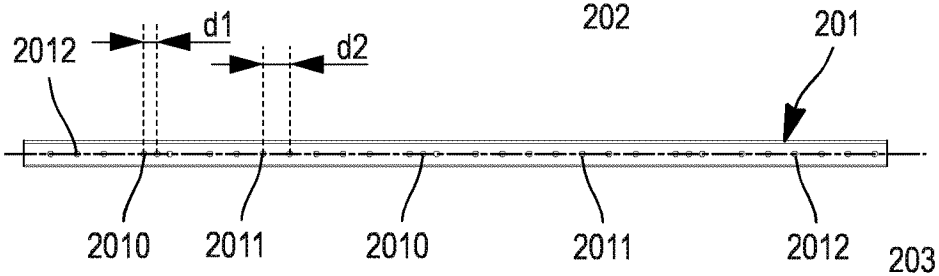
FIG. 4A a view of the first face of a profile according to the invention.
Figure 4B:
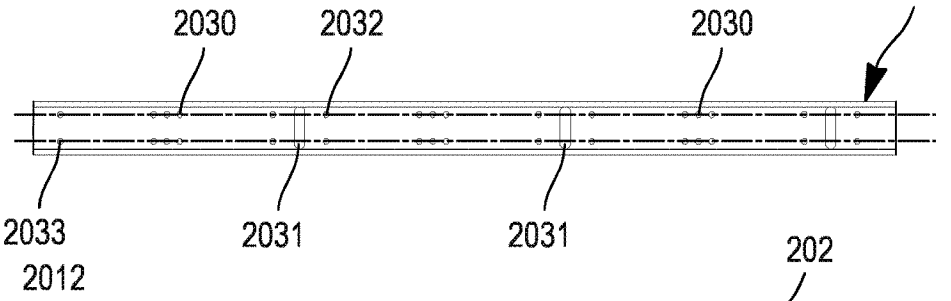
FIG. 4B a view of the third face of the profile according to the invention.
Figure 4C:
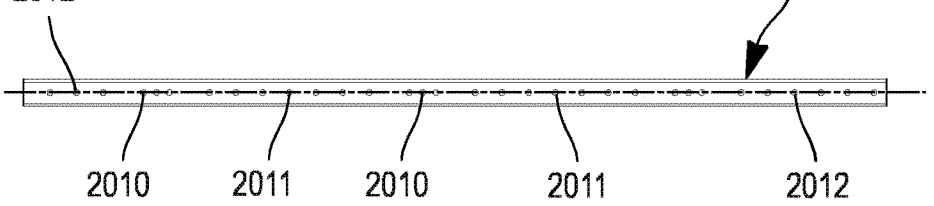
FIG. 4C a view of the second face of a profile according to the invention.

In order to be able to assemble the profiles easily in a standardised fashion, they are provided with holes organised as follows: the first face or wall 201 and the second face or wall 202 are provided with openings organised in sequences of the length L of the profile concerned. As shown in FIGS. 4A, 4B and 4C, each sequence comprises a first series of three openings 2010 aligned along the length L and equidistant by a distance d1. This series of openings is juxtaposed in a series of seven openings 2011 equidistant by a distance d2 greater d1. Preferentially d2 is equal to twice d1. The distance between each series of openings is here equal to the sum of d1 and d2. At the end of the first and second faces 201, 202, there are advantageously a plurality of openings 2012 aligned with the openings 2010, 2011 already described, preferentially at least three openings 2012 equidistant by a distance d2; by way of illustration, a multiple of three openings 2012 may be provided at one of the ends, and three openings at the other end of each face.

The third face or wall 203 as shown in FIG. 4B comprises two rows of three openings 2030 longitudinally equidistant by a distance d1 and placed opposite the openings 2010 provided in respectively the first and second faces 201, 202. Furthermore, opposite the opening placed at the middle of the openings 2011, an elongate opening 2031 over the height H is provided, and surrounded by at least four openings 2032 longitudinally placed facing the openings juxtaposed with the opening of the middle of the openings 2011. FIG. 4B illustrates such an arrangement of said openings. At the end of the face 203, at least two openings 2033 are provided, able to coincide longitudinally with the end openings 2012 of the faces 201 and 202.

In this way profiles 20, 21 are produced, provided with openings organised in standardised sequences. The distances between openings are equal to d1, d2 or a multiple of these values; this constitutes ease of manufacture that is very advantageous. Furthermore, the profiles 20, 21 are cut in situ to the required length. Such profiles make it possible advantageously to form a frame 1 and a bolted framework. The frame 1 is here formed by twice two profiles 20 parallel to each other, situated on the lower plane P2, and twice two profiles 21 situated at the upper plane P1. The first profiles 20 are bolted to the second profile 21.

Such profiles may also be contiguous at their third faces 203 in order to build an I-shaped profile, structurally more rigid than a U-shaped profile as described above. A person skilled in the art can easily build I-shaped profiles in particular by means of the presence of and at the arrangement of the predefined openings, which combine perfectly.

Figure 6:
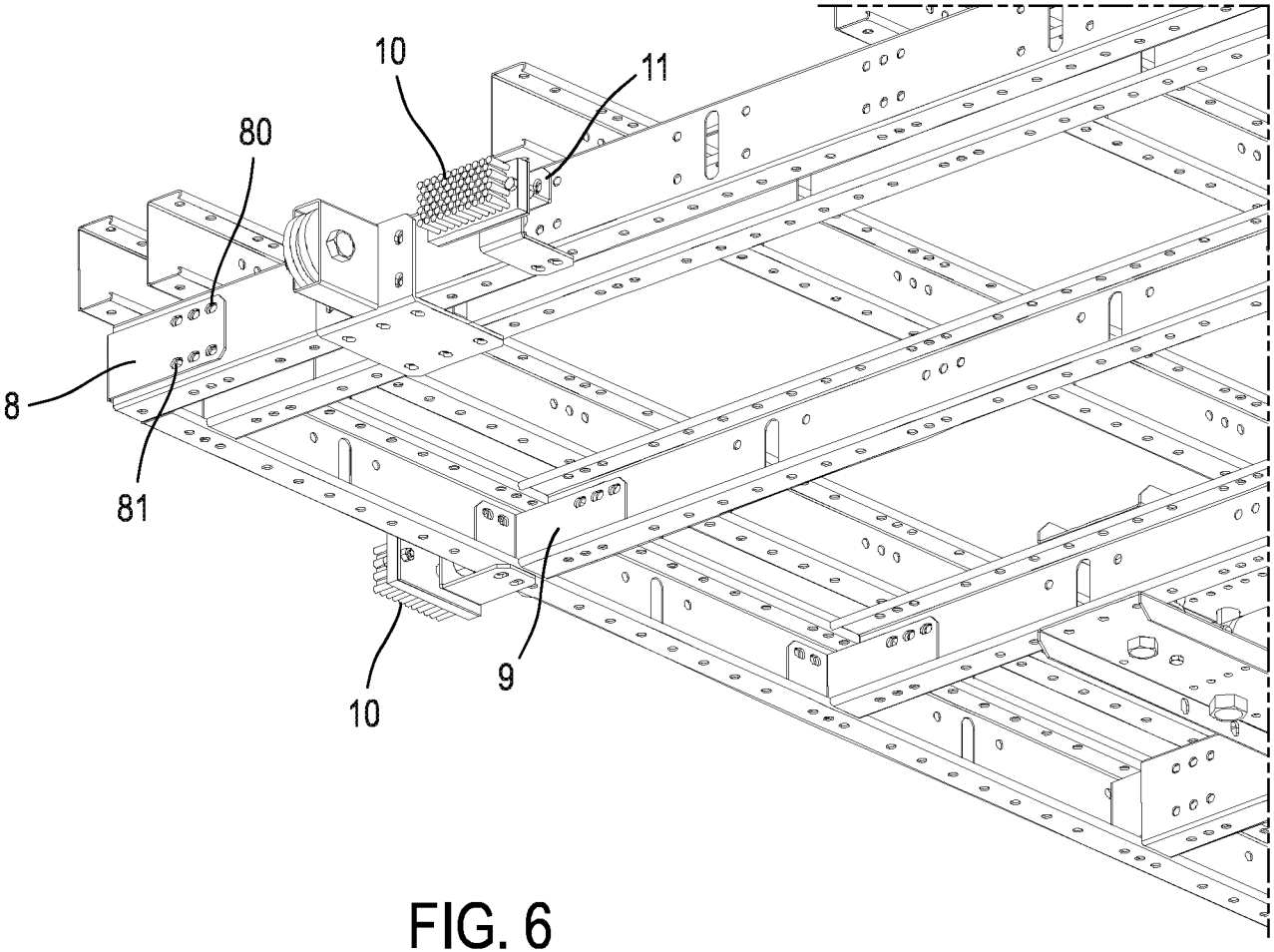
FIG. 6, a perspective view of a corner of the frame and of the framework.

Angle brackets 8 are provided in order to form the corners of the frame 1. These angle brackets 8, as can be seen in FIG. 6, are provided with aligned openings 80, 81 disposed on two levels, which correspond to the two levels of the openings 2030 of the third face 203 of a lower profile 21. This is because, as already stated, it is here preferred to fix the majority of the additional parts to the lower level P2 of the structure.

Thus stabilisation means 7 consisting for example of a brush 10 and a connecting piece 11 referred to as the brush support allowing a bolted connection to a profile 20 or 21 is preferentially fixed to a profile 21. The brush 10 is known per se. Characteristically, the brush support 11 has a U shape with a lug. One of the arms of the U is in contact with the first or second face of the profile concerned; this arm is provided with openings that preferentially correspond to the openings 2010 of the first 201 and second 202 faces, that is to say distant by d1. The base of the U has an opening for fixing an end piece of the brush 10. The lug of the U is perpendicular to its two main arms and comes into contact with the third face 203 of the profile. Fixing by bolts is provided. At least two openings distant by D1 are provided for this purpose in the lug of the brush support 11.

FIG. 6 also shows so-called longitudinal angle brackets 9 able to allow the fixing at a right angle of a longitudinal profile 21 with a profile of the frame 1. The longitudinal angle brackets 9 have here openings aligned on two levels that correspond in particular to the openings 2033 of the third face 203 of a profile. According to this representation there is a double row of three openings on the longest flank of the longitudinal angle bracket 9, and a double row of two openings on the shortest flank of the longitudinal angle bracket 9.

Figure 7:
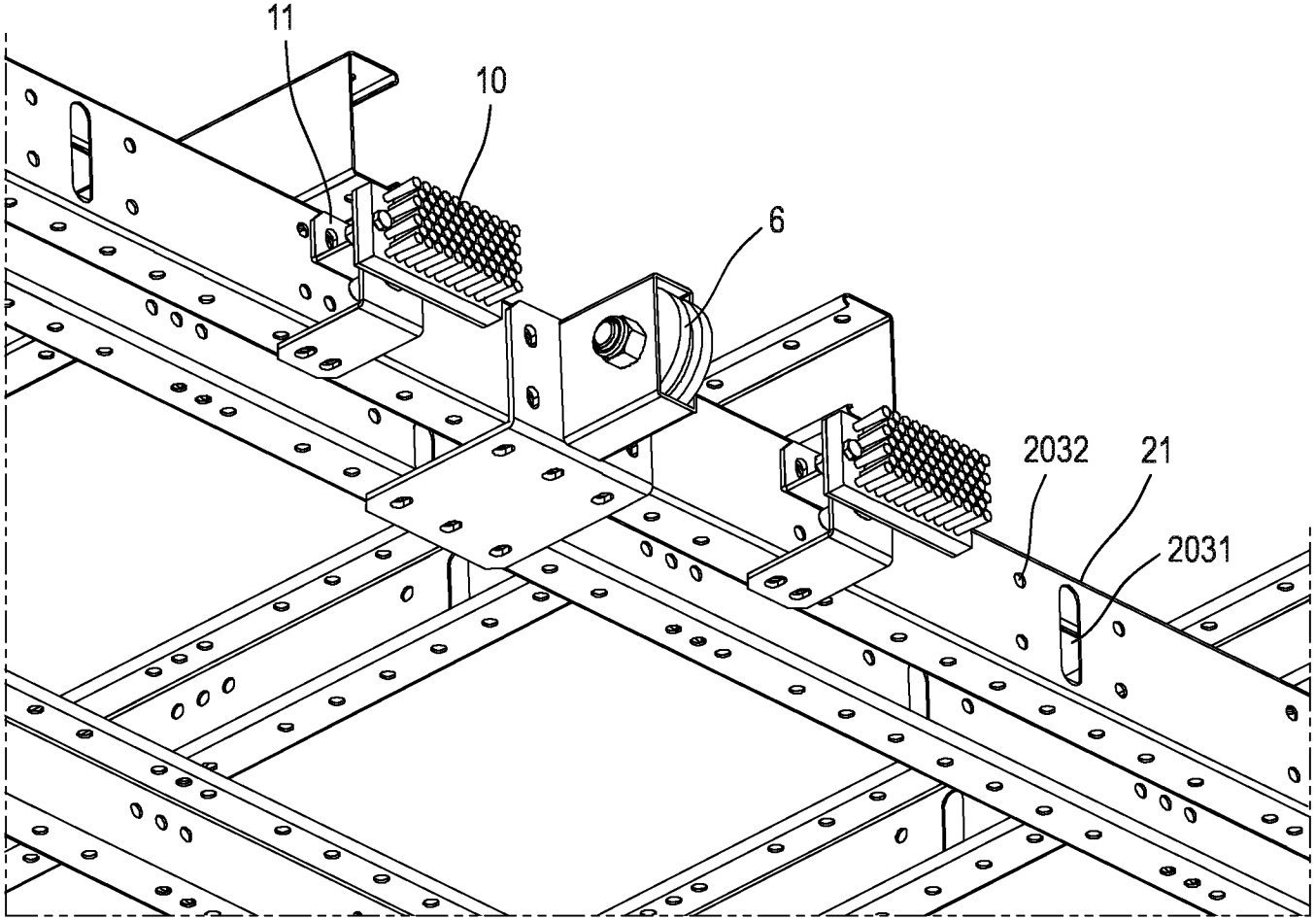
FIG. 7, a perspective view of a side of the frame and of the framework.

FIG. 7 moreover shows the connection between the frame 1 and a return pulley 6. The connecting part consists of an angle bracket provided here with two rows of three openings on one arm, for connection with the first 201 or second 202 face of a profile 21, and twice two openings on the second arm, which is in contact with the third face 203 of the profile. The openings of the second arm are placed opposite the openings 2032 of the third face.

An elongate additional opening (not referenced, not visible) is provided; its shape corresponds to an elongate opening 2031 provided in the third face of the profile. The pulley 6 itself is disposed facing the additional opening and the opening 2031 so that the rope or cable 4 wound on the pulley 6 easily passes through these openings. Preferentially, a second profile 21 is provided, disposed parallel to and at a short distance from the outermost profile 21. The second row of openings of the first arm affords connection with the second profile 21.

Figure 5:
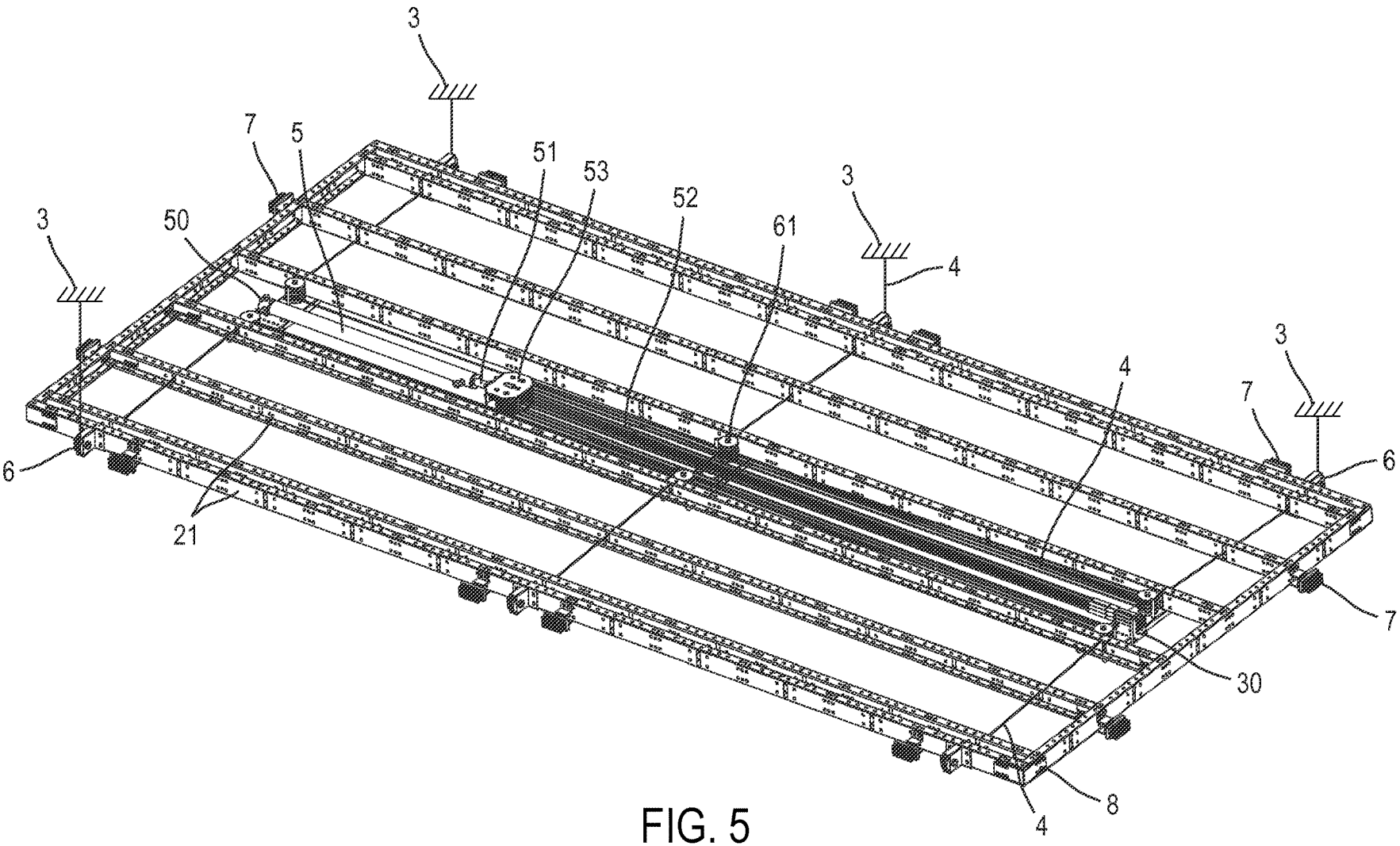
FIG. 5, a partial perspective view of a device according to an embodiment of the invention.

On one side of the frame 1, as many pulleys as necessary are provided. By way of non-limitative example, FIG. 1 and FIG. 5 illustrate an embodiment where three pulleys 6 are provided on each length of the frame 1. A cable 4 coming from an anchoring point 3 travels vertically over a longer or shorter distance and in the vicinity of a wall of the swimming pool, and is then diverted in a horizontal plane by another pulley fixed to the frame 1, as described above. Thanks to the arrangement and shape of the openings 2031 on the profiles, each cable 4 can be directed easily to a return pulley fixed at the central part of the device, more particularly at the lower plane P2 where the jack, other pulleys and the second fixing point 30 of the cables 4 are also fixed.

With regard to the means for raising and lowering the frame 1 and the framework, a jack, for example hydraulic, is preferably provided, disposed horizontally, and a first end 50 of which is fixed to a plate itself fixed between two lower profiles 21; the jack has a height less than or equal to the height H of the profile; it does not project beyond it in order not to increase the thickness of the device. Moreover, the jack 5 cooperates with a set of cables 4 having various routes between the anchoring points 3 and a plate for fixing the cables, fixed between two lower profiles 21. A set of pulleys 61 define the routes mainly disposed in or in the vicinity of the second plane P2. The pulleys 6, placed on the frame 1, allow a change in direction of the cables, between the horizontal plane and a vertical direction substantially vertically in line with an anchoring point 3. The second end 51 of the jack 5 is guided on a guide plate 52 and comprises a clevis 53 for holding the pulleys 61. Advantageously, these means are disposed at the lower plane P2. In this way a particular distribution of the cables 4 is provided which, by means of a pulley block system, allows, with an elongation of the jack 5, a travel of the meshed structure 1, 2 that is several times greater. The pulleys 61 placed on the plate 52 are so-called block and tackle pulleys. This feature is highly advantageous in terms of space requirement, strength and ergonomics of the device according to the invention.

The amplitude of the movement of the rod of the jack associated with the routing of the cables 4 enables the frame 1 and the framework 2 to pass alternately from a high position according to which the movable bottom fits flush with the surface of the ground bordering the cavity or swimming pool, to a low position in which the movable bottom is in contact with or very close to the bottom of the cavity or swimming pool.

FIGS. 1 and 5 show a preferred arrangement allowing a translational movement of the framework overall, which remains in a horizontal plane. The height H may be between 100 mm and 200 mm while the length of the profiles may be between one or two metres and one or two tens of metres. The jack 5 normally has a length of one metre and a development of one metre. The mesh may be 500 mm. The cables are for example made from treated steel and have a diameter of 6 mm. A person skilled in the art will size and choose the most suitable technical elements.

The invention claimed is:

1. A movable-bottom device for swimming pools or hollow cavities, comprising a frame fixed to a mesh framework comprising first profiles extending in a first direction and belonging to at least one first plane (P1) referred to as the upper plane and second profiles superimposed on the first profiles and extending in a second direction preferentially perpendicular to the first direction and belonging to a second plane (P2) referred to as the lower plane different from the first plane (P1), means for raising and lowering the frame and the framework, and means for motorising the raising and lowering means, characterised in that said first and second profiles have a U-shaped cross section having a first face and a second face parallel to each other and connected by a third face of height (H), the first face and the second face being provided with openings organised in sequences over the length L of the profile, each sequence comprising a first series of (N1) openings aligned and equidistant by a distance (d1), said series being juxtaposed with a second series of (N2) openings aligned and equidistant by a distance (d2) greater than (d1), the third face being provided with two rows of (N1) openings aligned and equidistant by a distance (d1) placed opposite the openings of the first and second faces and an opening elongate over the height (H) and surrounded by at least four openings aligned with the two rows of openings;

in that each end of a profile comprises openings on each face, and in that said profiles are bolted together.

2. A device according to claim 1, characterised in that it further comprises angle brackets provided with openings aligned on two levels for the fixing at a right angle of two profiles forming said frame, said angle bracket being bolted to each of said profiles.

3. A device according to claim 1, characterised in that it further comprises angle brackets provided with openings aligned on two levels for fixing at a right angle a profile forming the framework on a profile forming the frame, said angle brackets being bolted together.

4. A device according to claim 1, characterised in that it further comprises stabilisation means placed at the periphery of the frame, able to achieve sliding contact between said frame and the internal wall of the swimming pool or hollow cavity.

5. A device according to claim 4, characterised in that said stabilisation means comprise brushes fixed to the periphery of the frame, by means of a support, able to be bolted to one of the first or second faces of a profile of the framework and to its third face.

6. A device according to claim 1, characterised in that at least one side forming said frame comprises two parallel profiles fixed together via an intermediate part.

7. A device according to claim 1, characterised in that said raising and lowering means comprise at least one jack disposed substantially in said lower plane (P2).

8. A device according to claim 7, characterised in that said jack is fixed between two second profiles of the framework, said jack having a first fixed end and a second movable end guided on a plate and cooperating with at least one pulley, at least one cable being provided with a first end fixed to an anchoring point of the internal wall of the swimming pool or hollow cavity and a second end fixed to an anchoring element connected to the meshed framework.

9. A device according to claim 7, characterised in that said jack is motorised.

10. A device according to claim 1, characterised in that the number (N1) of the first series of openings is equal to three and in that the number (N2) of the second series of openings is equal to seven.

* * * * *